US011609525B2

(12) United States Patent
Kano et al.

(10) Patent No.: US 11,609,525 B2
(45) Date of Patent: Mar. 21, 2023

(54) POST-PROCESSING DEVICE AND IMAGE FORMING APPARATUS

(71) Applicant: FUJIFILM Business Innovation Corp., Tokyo (JP)

(72) Inventors: Yoshiji Kano, Kanagawa (JP); Shinya Takahashi, Kanagawa (JP); Tomoko Taguchi, Kanagawa (JP); Masaaki Takahashi, Kanagawa (JP); Hiroshi Ashizawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/151,687

(22) Filed: Jan. 19, 2021

(65) Prior Publication Data

US 2022/0050412 A1 Feb. 17, 2022

(30) Foreign Application Priority Data

Aug. 14, 2020 (JP) ..... JP2020-137075

(51) Int. Cl.
*G03G 15/00* (2006.01)
*G03G 21/20* (2006.01)

(52) U.S. Cl.
CPC ..... *G03G 15/6573* (2013.01); *G03G 21/206* (2013.01); *G03G 21/20* (2013.01)

(58) Field of Classification Search
CPC ..... G03G 15/6573; G03G 21/206
See application file for complete search history.

(56) References Cited

U.S. PATENT DOCUMENTS

2006/0093420 A1* 5/2006 Oba ..... G03G 15/6573 399/405
2010/0272456 A1* 10/2010 Kurita ..... G03G 15/6573 399/92
2011/0170883 A1* 7/2011 Suzuki ..... G03G 15/6573 399/18
2018/0052417 A1* 2/2018 Maruyama ..... G03G 21/206

FOREIGN PATENT DOCUMENTS

JP 2007145534 * 6/2007
JP 2016-052941 4/2016

* cited by examiner

*Primary Examiner* — Arlene Heredia
(74) *Attorney, Agent, or Firm* — JCIPRNET

(57) ABSTRACT

A post-processing device includes an output unit that outputs a medium; a stacking unit on which the medium that is output is stacked; and a blow-out unit that is disposed below the output unit and that blows gas toward the medium that is output, wherein an amount of the gas blown is adjusted in accordance with a type of the medium.

8 Claims, 7 Drawing Sheets

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2020-137075 filed Aug. 14, 2020.

BACKGROUND

(i) Technical Field

The present disclosure relates to a post-processing device and an image forming apparatus.

(ii) Related Art

Japanese Unexamined Patent Application Publication No. 2016-52941 ([0031] to [0045], FIGS. 2 to 5) describes a known technique for blowing gas toward a medium output from an image forming apparatus.

According to Japanese Unexamined Patent Application Publication No. 2016-52941, a sheet (S) that has passed through a fixing device and whose temperature has been increased is cooled by a suction fan (4) disposed in the image forming apparatus, and is then cooled by gas blown from above the sheet (S) by a cooling unit (11) disposed outside the image forming apparatus.

SUMMARY

Aspects of non-limiting embodiments of the present disclosure relate to a reduction of improper stacking of a medium on a stacking unit compared to when gas is blown against the medium similarly irrespective of the type of the medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a post-processing device including an output unit that outputs a medium; a stacking unit on which the medium that is output is stacked; and a blow-out unit that is disposed below the output unit and that blows gas toward the medium that is output, wherein an amount of the gas blown is adjusted in accordance with a type of the medium.

BRIEF DESCRIPTION OF THE DRAWINGS

An exemplary embodiment of the present disclosure will be described in detail based on the following figures, wherein:

FIGS. 4A and 4B illustrate the manner in which a medium is output by a structure according to the related art, wherein FIG. 4A illustrates a state in which the leading end of the medium has come into contact with an output tray, and FIG. 4B illustrates a state in which the medium is further output from the state illustrated in FIG. 4A;

FIGS. 5A and 5B illustrate an operation of the exemplary embodiment in which plain paper is used, wherein FIG. 5A illustrates a state after passage through the output exit and before contact, and FIG. 5B illustrates a state after contact.

DETAILED DESCRIPTION

Figure 1:
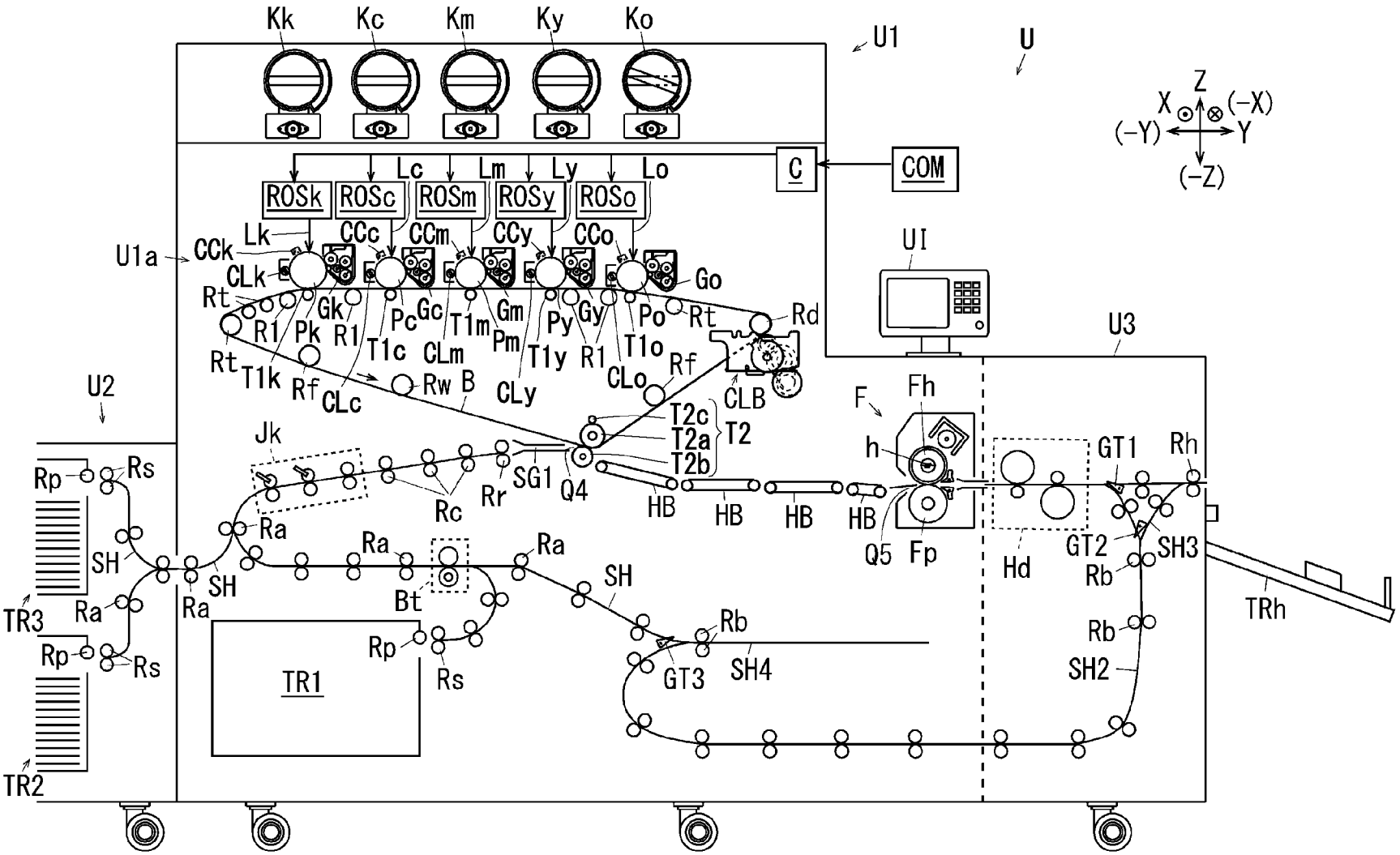
FIG. 1 illustrates the overall structure of an image forming apparatus according to an exemplary embodiment.

An exemplary embodiment of the present disclosure will now be described with reference to the drawings. However, the present disclosure is not limited to the exemplary embodiment described below.

To facilitate understanding of the following description, in each figure, the front-back direction (medium width direction), the left-right direction (medium transporting direction), and the up-down direction are defined as the X-axis direction, the Y-axis direction, and the Z-axis direction, respectively. In addition, the directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In addition, in each figure, a circle with a dot in the middle shows the direction coming out of the page, and a circle with an X in the middle shows the direction going into the page.

In the drawings, components other than those to be described with reference to the drawings are omitted as appropriate to facilitate understanding.

Description of Overall Structure of Printer U of Exemplary Embodiment

FIG. 1 illustrates the overall structure of an image forming apparatus according to an exemplary embodiment.

Referring to FIG. 1, a printer U is an example of an image forming apparatus according to the exemplary embodiment of the present disclosure. The printer U includes a printer body U1, a feeder unit U2, an operation unit UI, and a finisher U3. The feeder unit U2 is an example of a supply device that supplies a medium to the printer body U1. The operation unit UI is operated by a user. The finisher U3 is an example of a post-processing device that performs post-processing on the medium output from the printer body U1.

Description of Marking Structure of Exemplary Embodiment

Referring to FIG. 1, the printer body U1 includes a controller (example of a control unit) C, a communication unit (not illustrated), and a marking unit U1*a*. The controller C controls the printer U. The communication unit receives image information transmitted from a print image server COM, which is an example of an information transmission device connected to a unit outside the printer U by a dedicated cable (not illustrated). The marking unit U1*a* is an example of a recording unit that records an image on the medium. The print image server COM is connected to a personal computer PC by a line, such as a cable or a local area network (LAN). The personal computer PC is an example of an image transmission device that transmits information of an image to be printed by the printer U.

The marking unit U1*a* includes photoconductors Py, Pm, Pc, and Pk for respective colors, which are yellow (Y), magenta (M), cyan (C), and black (K), and a photoconductor Po used to make an image glossy when, for example, a photographic image is printed. The photoconductors Py to Po are examples of image carriers, and are each made of a dielectric having a photosensitive surface.

Referring to FIG. 1, a charging device CCk, an exposure device ROSk, a developing device Gk, a first transfer roller T1*k*, and a photoconductor cleaner CLk are arranged around the black photoconductor Pk in that order in a direction in which the photoconductor Pk rotates. The charging device CCk is an example of a charging unit. The exposure device ROSk is an example of a latent-image forming unit. The developing device Gk is an example of a developing unit. The first transfer roller T1*k* is an example of a first transfer unit. The photoconductor cleaner CLk is an example of an image-carrier cleaning unit.

Similarly, charging devices CCy, CCm, CCc, and CCo, exposure devices ROSy, ROSm, ROSc, and ROSo, developing devices Gy, Gm, Gc, and Go, first transfer rollers T1*y*, T1*m*, T1*c*, and T1*o*, and photoconductor cleaners CLy, CLm, CLc, and CLo are disposed around the other photoconductors Py, Pm, Pc, and Po.

Toner cartridges Ky, Km, Kc, Kk, and Ko, which are examples of developer containers, are removably supported above the marking unit U1*a*. Developers to be supplied to the developing devices Gy to Go are contained in the toner cartridges Ky to Ko.

An intermediate transfer belt B, which is an example of an intermediate transfer unit and which is also an example of an image carrier, is disposed below the photoconductors Py to Po. The intermediate transfer belt B is disposed between each of the photoconductors Py to Po and a corresponding one of the first transfer rollers T1*y* to T1*o*. The inner surface of the intermediate transfer belt B is supported by a driving roller Rd, a tension roller Rt, a walking roller Rw, plural idler rollers Rf, a backup roller T2*a*, plural retractable rollers R1, and the first transfer rollers T1*y* to T1*o*. The driving roller Rd is an example of a driving unit. The tension roller Rt is an example of a tension-applying unit. The walking roller Rw is an example of a meandering prevention unit. The idler rollers Rf are examples of driven units. The backup roller T2*a* is an example a second-transfer facing unit. The retractable rollers R1 are examples of movable units.

A belt cleaner CLB, which is an example of an intermediate-transfer-unit cleaning unit, is disposed on the outer surface of the intermediate transfer belt B at a position close to the driving roller Rd.

A second transfer roller T2*b*, which is an example of a second transfer member, faces the backup roller T2*a* with the intermediate transfer belt B disposed therebetween. A contact roller T2*c*, which is an example of a contact unit, is in contact with the backup roller T2*a* to apply a voltage of the same polarity as the charging polarity of the developers to the backup roller T2*a*.

The backup roller T2*a*, the second transfer roller T2*b*, and the contact roller T2*c* constitute a second transfer device T2, which is an example of a second transfer unit according to the exemplary embodiment. The first transfer rollers T1*y* to T1*o*, the intermediate transfer belt B, the second transfer device T2, and other components constitute a transfer apparatus T1, B, T2, which is an example of a transfer unit according to the exemplary embodiment.

A paper feed tray TR1, which is an example of a container, is provided below the second transfer device T2. Recording sheets S, which are examples of media, are stored in the paper feed tray TR1. A pick-up roller Rp, which is an example of a pick-up unit, and separation rollers Rs, which are examples of separation units, are disposed in an upper right region of the paper feed tray TR1. A transport path SH, along which the recording sheets S are transported, extends from the separation rollers Rs. Plural transport rollers Ra, which are examples of transport units that transport the recording sheets S downstream, are arranged along the transport path SH.

A deburring device Bt, which is an example of an unnecessary-portion-removing unit, is disposed downstream of the separation rollers Rs. The deburring device Bt performs deburring, which is a process of removing unnecessary portions at the edges of each recording sheet S by transporting the recording sheet S downstream while nipping the recording sheet S at a preset pressure.

A double-feeding detection device Jk is disposed downstream of the deburring device Bt. The double-feeding detection device Jk measures the thickness of the recording sheets S that pass therethrough to detect double feeding, which is a state in which multiple recording sheets S are transported in an overlapping state.

Correction rollers Rc, which are examples of position correction units, are disposed downstream of the double-feeding detection device Jk. The correction rollers Rc correct a skew, that is, an inclination of each recording sheet S with respect to the transporting direction.

Registration rollers Rr, which are examples of adjustment units that adjust the time at which each recording sheet S is transported to the second transfer device T2, are disposed downstream of the correction rollers Rc. A sheet guide SG1, which is an example of a medium guide unit, is disposed downstream of the registration rollers Rr.

The feeder unit U2 also includes paper feed trays TR2 and TR3 and other components that are structured similarly to the paper feed tray TR1, the pick-up roller Rp, the separation rollers Rs, and the transport rollers Ra. A transport path SH that extends from the paper feed trays TR2 and TR3 joins the transport path SH in the printer body U1 at a position upstream of the double-feeding detection device Jk.

Plural transport belts HB, which are examples of medium transport units, are disposed downstream of the second transfer roller T2*b* in the transporting direction of the recording sheet S.

A fixing device F, which is an example of a fixing unit, is disposed downstream of the transport belts HB in the transporting direction of the recording sheet S.

A decurler Hd, which is an example of a curvature-reducing unit, is disposed in the finisher U3, which is located downstream of the fixing device F. The decurler Hd reduces the curvature, or curl, of the recording sheet S by applying a pressure to the recording sheet S.

A transport path SH that extends toward an output tray TRh, which is an example of a stacking unit, is provided downstream of the decurler Hd. Output rollers Rh, which are examples of output units, are disposed at the downstream end of the transport path SH.

A reversing path SH2, which is an example of a transport path that branches from the transport path SH, is provided downstream of the decurler Hd. A first gate GT1, which is an example of a transporting-direction-switching unit, is disposed at the branching point at which the reversing path SH2 branches from the transport path SH.

The reversing path SH2 has plural switchback rollers Rb, which are examples of transport units that are rotatable in forward and reverse directions. A connection path SH3 is provided upstream of the switchback rollers Rb. The connection path SH3 is an example of a transport path that branches from an upstream portion of the reversing path SH2 and joins the transport path SH at a position downstream of the branching point at which the reversing path SH2 branches from the transport path SH. A second gate GT2, which is an example of a transporting-direction-switching unit, is disposed at the branching point at which the connection path SH3 branches from the reversing path SH2.

A switchback path SH4 is disposed downstream of the reversing path SH2 and below the fixing device F. The switchback path SH4 is used to reverse the transporting direction of the recording sheet S, that is, to transport the recording sheet S in a switchback manner. The switchback path SH4 has switchback rollers Rb, which are examples of transport units that are rotatable in forward and reverse directions. In addition, a third gate GT3, which is an example of a transporting-direction-switching unit, is disposed is at the entrance of the switchback path SH4.

A transport path SH disposed downstream of the switchback path SH4 joins the transport path SH that extends from the paper feed tray TR1.

Marking Operation

The printer U starts a job, which is an image forming operation, when the printer U receives image information transmitted from the personal computer PC through the print image server COM. When the job is started, the photoconductors Py to Po, the intermediate transfer belt B, and other components rotate.

The photoconductors Py to Po are driven by a drive source (not illustrated).

The charging devices CCy to CCo receive a preset voltage and charge the surfaces of the respective photoconductors Py to Po.

The exposure devices ROSy to ROSo respectively output laser beams Ly, Lm, Lc, Lk, and Lo, which are examples of light beams for writing latent images, in accordance with control signals from the controller C, thereby writing electrostatic latent images on the charged surfaces of the photoconductors Py to Po.

The developing devices Gy to Go develop the electrostatic latent images on the surfaces of the respective photoconductors Py to Po into visible images.

The toner cartridges Ky to Ko supply the developers to the respective developing devices Gy to Go, which consume the developers in the developing process.

The first transfer rollers T1*y* to T1*o* receive a first transfer voltage having a polarity opposite to the charging polarity of the developers, so that the visible images on the surfaces of the photoconductors Py to Po are transferred onto the intermediate transfer belt B.

The photoconductor cleaners CLy to CLo clean the surfaces of the respective photoconductors Py to Po by removing the developers that remain on the surfaces of the photoconductors Py to Po after the first transfer process.

The intermediate transfer belt B passes through first transfer regions, in which the intermediate transfer belt B faces the photoconductors Py to Po. At this time, O, Y, M, C, and K images are transferred onto the intermediate transfer belt B in that order. Then, the intermediate transfer belt B passes through a second transfer region Q4, in which the intermediate transfer belt B faces the second transfer device T2. In a case where a monochrome image is formed, an image of a single color is transferred onto the intermediate transfer belt B and transported toward the second transfer region Q4.

The recording sheets S are fed from one of the paper feed trays TR1 to TR3 by the corresponding pick-up roller Rp in accordance with, for example, the size of the received image information, designation of the recording sheets S, and the sizes and types of the recording sheets S that are stored.

The separation rollers Rs separate the recording sheets S fed by the pick-up roller Rp from each other.

The deburring device Bt applies a preset pressure to each recording sheet S that passes therethrough to deburr the recording sheet S.

The double-feeding detection device Jk detects the thickness of the recording sheets S that pass therethrough to detect double feeding of the recording sheets S.

The correction rollers Rc correct a skew of each recording sheet S that passes therethrough by bringing the recording sheet S into contact with a wall surface (not illustrated).

The registration rollers Rr feed the recording sheet S in accordance with the time when the images on the surface of the intermediate transfer belt B reach the second transfer region Q4.

The sheet guide SG1 guides the recording sheet S fed by the registration rollers Rr to the second transfer region Q4.

The backup roller T2*a* of the second transfer device T2 receives a preset second transfer voltage having the same polarity as the charging polarity of the developers through the contact roller T2*c*, so that the images on the intermediate transfer belt B are transferred onto the recording sheet S.

The belt cleaner CLB cleans the intermediate transfer belt B by removing the developers that remain on the surface of the intermediate transfer belt B after the images are transferred in the second transfer region Q4.

The transport belts HB hold the recording sheet S to which the images have been transferred by the second transfer device T2 on the surfaces thereof, and transport the recording sheet S downstream.

The fixing device F includes a heating roller Fh, which is an example of a heating member, and a pressing roller Fp, which is an example of a pressing member. A heater h, which is an example of a heat source, is disposed in the heating roller Fh. The fixing device F heats the recording sheet S that passes through a fixing region Q5, in which the heating roller Fh and the pressing roller Fp are in contact with each other, while pressing the recording sheet S, thereby fixing the unfixed images on the surface of the recording sheet S to the recording sheet S. The heating roller Fh and the pressing roller Fp constitute a fixing member Fp, Fh according to the exemplary embodiment.

The decurler Hd applies a pressure to the recording sheet S that has passed through the fixing device F to remove the curvature, or curl, of the recording sheet S.

When the recording sheet S that has passed through the decurler Hd is to be subjected to double-sided printing, the first gate GT1 is activated so that the recording sheet S is transported to the reversing path SH2, transported in a switchback manner along the switchback path SH4, and then fed to the registration rollers Rr again along the transport path SH. Then, printing is performed on a second surface of the recording sheet S.

When the recording sheet S is to be output onto the output tray TRh face-up, that is, such that the surface on which an image is recorded faces upward, the recording sheet S is transported along the transport path SH and output onto the output tray TRh by the output rollers Rh.

When the recording sheet S is to be output face-down, that is, such that the surface on which the image is recorded faces downward, the recording sheet S is temporarily transported from the transport path SH to the reversing path SH2. After the trailing end of the recording sheet S in the transporting direction has passed the second gate GT2, forward rotation of the switchback rollers Rb is stopped. Then, the second gate GT2 is switched and the switchback rollers Rb are rotated in the reverse direction so that the recording sheet S is transported to the output tray TRh along the connection path SH3. The output recording sheet S is placed on the output tray TRh.

Description of Blowing Mechanism

Figure 2:
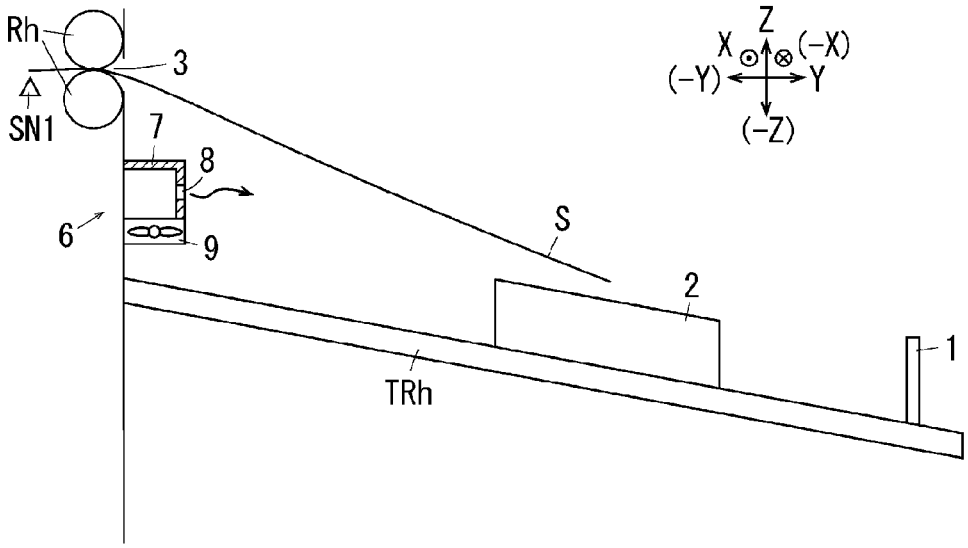
FIG. 2 is a side view of a portion of a post-processing device including an output exit according to the exemplary embodiment.

FIG. 2 is a side view of a portion of the post-processing device including an output exit according to the exemplary embodiment.

Figure 3:
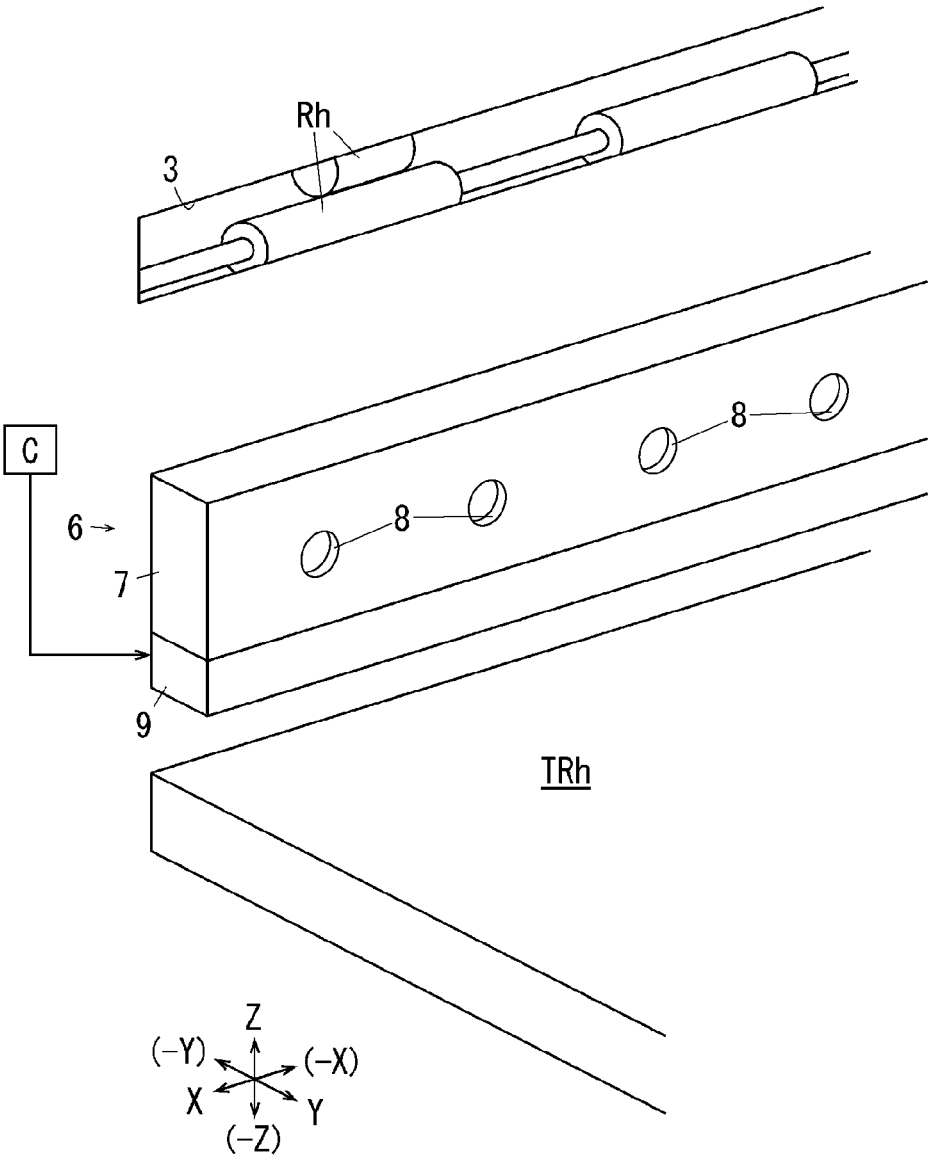
FIG. 3 is a perspective view of a relevant part of the post-processing device including the output exit according to the exemplary embodiment.

FIG. 3 is a perspective view of a relevant part of the post-processing device including the output exit according to the exemplary embodiment.

Referring to FIGS. 1 to 3, in the exemplary embodiment, the output tray TRh is inclined downstream in the sheet transporting direction and downward in the direction of gravity. The output tray TRh includes an end guide 1, which is an example of a stopper unit, at the downstream end thereof in the direction of gravity. The output tray TRh also includes a side guide 2, which is also an example of a stopper unit, at a deep side (back side) thereof, which is an example of the other side in a width direction.

A blowing device 6, which is an example of a blow-out unit, is disposed below an output exit 3 through which the sheet S output by the output rollers Rh passes. The blowing device 6 includes a housing 7. The housing 7 according to the exemplary embodiment has a hollow rectangular tubular shape that extends in the front-back direction, which is a width direction of the sheet S. The housing 7 has plural blow-out holes 8. The blow-out holes 8 are arranged with gaps therebetween in the width direction of the sheet S. In the exemplary embodiment, for example, the blow-out holes 8 are arranged over a region extending to positions corresponding to both ends of widest paper that is usable.

A fan 9, which is an example of a gas transporting unit, is disposed below the housing 7. The fan 9 according to the exemplary embodiment sucks outside air into the housing 7. Accordingly, the gas that has been sucked into the housing 7 is blown out through the blow-out holes 8.

The controller C according to the exemplary embodiment includes an input/output interface I/O through which signals are input and output from/to an external device. The controller C also includes a read-only memory (ROM) in which programs, information, etc. used to perform necessary processes are stored. The controller C also includes a random-access memory (RAM) that temporarily stores necessary data. The controller C also includes a central processing unit (CPU) that performs processes in accordance with the programs stored in, for example, the ROM. Thus, the controller C according to the exemplary embodiment is composed of a microcomputer. The controller C provides various functions by executing the programs stored in, for example, the ROM.

The controller C according to the exemplary embodiment controls the fan 9 to adjust the flow volume, which is the amount of gas blown from the blow-out holes 8, in accordance with the type of the sheet S. In the exemplary embodiment, the type of the sheet S that is used is determined based on the basis weight (weight per unit area) of the sheet S. For example, when the sheet S has a basis weight of less than 60 [g/m$^2$], which is an example a first threshold, it is determined that the sheet S is thin paper. When the sheet S has a basis weight of greater than 90 [g/m$^2$], which is an example of a second threshold, it is determined that the sheet S is thick paper. Accordingly, when the sheet S has a basis weight in the range of 60 to 90 [g/m$^2$], it is determined that the sheet S is plain paper. The specific values of the basis weight are not limited to the above-mentioned values, and may be changed to any values in accordance with the design and specifications.

Figure 7:
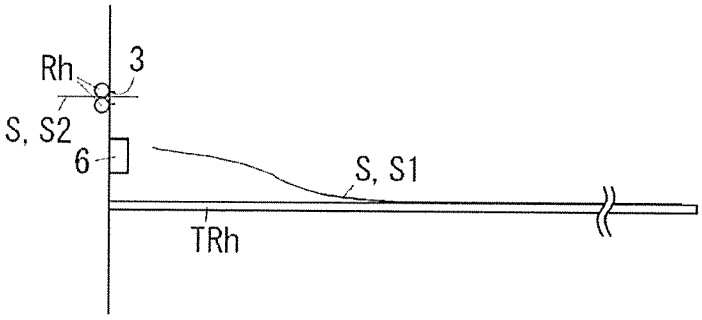
FIG. 7 illustrates an example of a case in which thin paper is used, the controller sets the amount of gas blown against the trailing end portion of the sheet in the transporting direction to zero.
Figure 8:
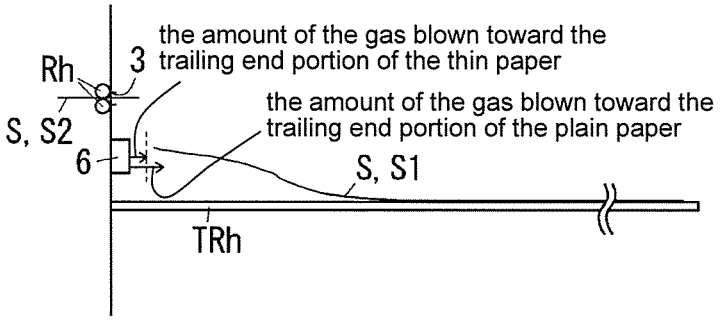
FIG. 8 illustrates an example of a case in which thin paper is used, the amount of the gas blown toward the trailing end portion of the thin paper is half of the amount of the gas blown toward the trailing end portion of the plain paper.

When the sheet S is thin paper, the controller C controls the rotation of the fan 9 so that the amount of gas blown against the sheet S (flow volume) is less than that when the sheet S is plain paper. For example, when the sheet S is thin paper, the flow volume is reduced to half of that when the sheet S is plain paper (referred to FIG. 8). In addition, when the sheet S is thin paper, the controller C according to the exemplary embodiment sets the amount of gas blown against the trailing end portion of the sheet S in the transporting direction to zero (referred to FIG. 7). More specifically, when a paper sheet sensor SN1, which is an example of a detection unit disposed upstream of and close to the output rollers Rh, detects the leading end of the sheet S in the transporting direction, the blowing of gas is started. Then, when the paper sheet sensor SN1 detects the trailing end of the sheet S, the blowing of gas is stopped. Thus, gas is blown from the blow-out holes 8 at a low flow volume when the leading end portion of the sheet S in the transporting direction reaches the output tray TRh, and no gas is blown from the blow-out holes 8 when the trailing end portion reaches the output tray TRh.

When the sheet S is plain paper, the controller C according to the exemplary embodiment controls the fan 9 so that gas is blown against the sheet S at a predetermined flow volume. In addition, in the exemplary embodiment, when the sheet S is plain paper, gas is continuously blown during output of the sheet S.

When the sheet S is thick paper, the controller C according to the exemplary embodiment controls the fan 9 so that the flow volume of the gas blown against the sheet S is less than that when the sheet S is plain paper. For example, when the sheet S is thick paper, the flow volume is set to zero.

Operations of Exemplary Embodiment

Figure 4A:
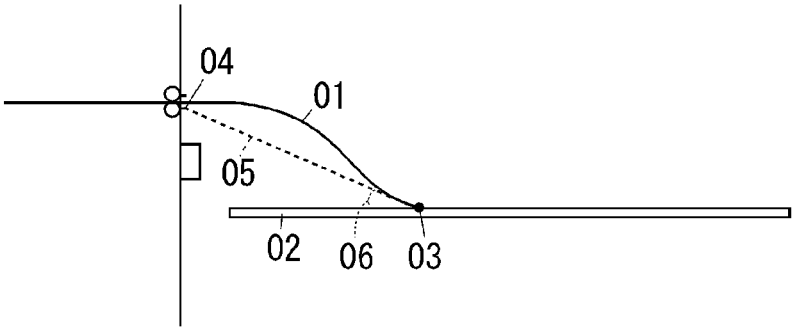
FIG. 4A RELATED ART
Figure 4B:
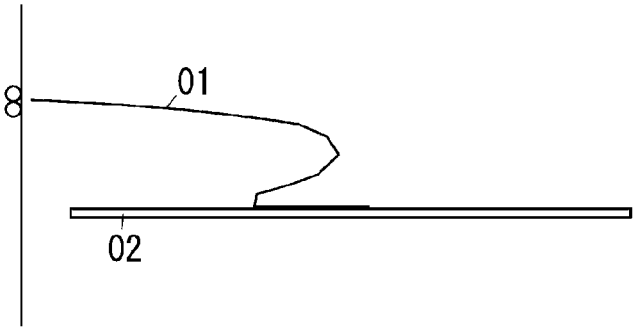
FIG. 4B RELATED ART

FIGS. 4A and 4B illustrate the manner in which a medium is output by a structure according to the related art, wherein FIG. 4A illustrates a state in which the leading end of the medium has come into contact with an output tray and FIG. 4B illustrates a state in which the medium is further output from the state illustrated in FIG. 4A.

In the finisher U3 according to the exemplary embodiment having the above-described structure, gas is blown at a preset flow volume when the sheet S is plain paper.

Referring to FIGS. 4A and 4B, when no gas is blown against a sheet 01 as in the structure of the related art, the leading end of the sheet 01 in the transporting direction falls and comes into contact with an output tray 02 at a position that is relatively upstream in the transporting direction, as illustrated in FIG. 4A. Therefore, an angle 06 between an imaginary line 05 connecting a contact position 03 and an output exit 04 and the upper surface of the output tray 02 is relatively large. Here, the sheet 01 may be, for example, thin paper with low stiffness or coated paper having a high coefficient of friction with respect to the output tray. In such a case, when the sheet 01 is further transported, there is a risk that the frictional force between the sheet 01 and that the output tray 02 will exceed the stiffness of the sheet 01 and the sheet 01 will buckle instead of moving downstream, as illustrated in FIG. 4B. When the sheet 01 buckles, improper stacking may occur. More specifically, the sheet 01 may be bent, reversed upside down, or stacked in an incorrect order.

Figure 5A:
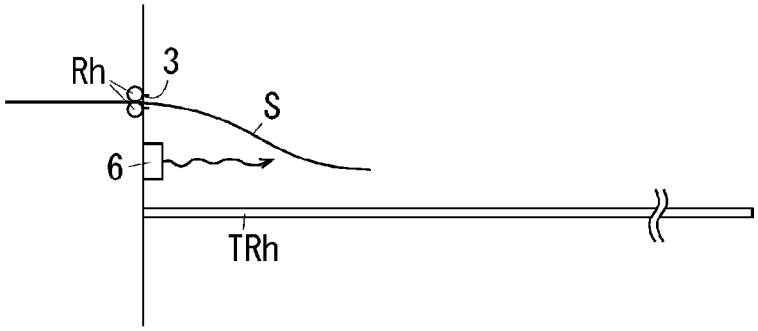
Figure 5B:
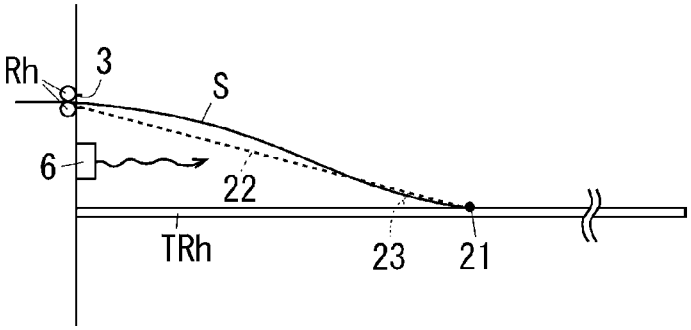

FIGS. 5A and 5B illustrate an operation of the exemplary embodiment in which plain paper is used, wherein FIG. 5A illustrates a state after passage through the output exit and before contact, and FIG. 5B illustrates a state after contact.

In the exemplary embodiment, gas is blown against the sheet S, so that the leading end of the sheet S in the transporting direction is easily raised. Accordingly, the leading end of the sheet S in the transporting direction comes into contact with the upper surface of the output tray TRh at a position further downstream in the transporting direction. Therefore, an angle 23 between an imaginary line 22 connecting a contact position 21 and the output exit 3 and the upper surface of the output tray TRh is smaller than that in FIG. 4A. Accordingly, the direction in which frictional force is applied (direction along the upper surface of the output tray TRh) is closer to the long-side direction of the sheet S (output direction in which the sheet S is output), and the sheet S does not easily buckle. As a result, the occurrence of improper stacking of the sheet S may be reduced.

Figure 6:
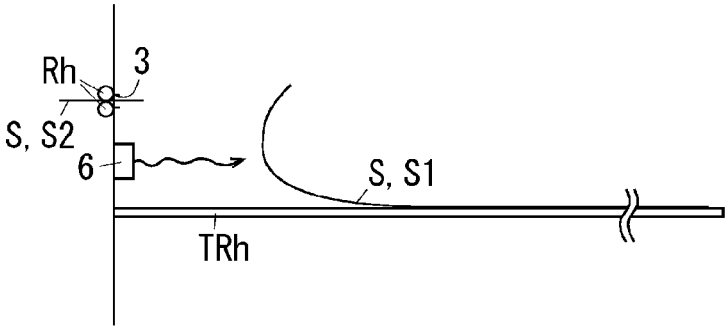
FIG. 6 illustrates an example of a case in which thin paper is used and in which gas is continuously blown against a trailing end portion of the thin paper.

FIG. 6 illustrates an example of a case in which thin paper is used and in which gas is continuously blown against a trailing end portion of the thin paper.

In the finisher U3 according to the exemplary embodiment, when the sheet S is thin paper, gas is blown against the sheet S at a flow volume less than that when the sheet S is plain paper. When the sheet S is thin paper that is light, the sheet S is easily raised and does not easily fall onto the output tray TRh if gas is blown thereagainst at the same flow volume as that when the sheet S is plain paper. If the sheet S is continuously raised, there is a risk that the sheet S will be displaced in the output direction or the width direction of the sheet S and that the level of alignment of the sheet S will be reduced. In contrast, in the exemplary embodiment, the flow volume is reduced when the sheet S is thin paper. Therefore, the risk that the sheet S will be continuously raised and that the level of alignment will be reduced is lower than when the flow volume is not reduced.

In addition, when the sheet S is thin paper, there is a risk that the trailing end of the sheet S will be flipped, as illustrated in FIG. 6, if gas is continuously blown against the trailing end portion of the sheet S. When the following sheet S2 is output in this state, there is a possibility that the leading end of the following sheet S2 in the transporting direction will be inserted under the trailing end of the preceding sheet S1. Therefore, there is a risk that the sheets S will be stacked on the output tray TRh in an incorrect order. In contrast, according to the exemplary embodiment, when the sheet S being output is thin paper, gas is not blown against the trailing end portion of the sheet S (referred to FIG. 7). Therefore, flipping of the trailing end of the sheet S may be suppressed, and the sheet S may be prevented from being stacked in an incorrect order.

In the finisher U3 according to the exemplary embodiment, no gas is blown against thick paper. Thick paper has high stiffness and does not easily buckle. Therefore, improper stacking of thick paper does not easily occur even when the blowing of gas is not performed. According to the exemplary embodiment, compared to when gas is also blown against thick paper, electric power for operating the fan 9 may be more easily reduced. In addition, damage over time and the risk of breakage of the fan 9 may also be reduced, so that the maintenance cost may be reduced.

Modifications

Although an exemplary embodiment of the present disclosure have been described in detail, the present disclosure is not limited to the above-described exemplary embodiment, and various modifications are possible within the gist of the present disclosure described in the claims. Modifications (H01) to (H010) of the present disclosure will now be described.

(H01) Although the printer U is described as an example of an image forming apparatus in the above-described exemplary embodiment, the image forming apparatus is not limited to this, and may instead be, for example, a copy machine, a facsimile machine, or a multifunction machine having some or all of the functions of these machines. Also, the image forming apparatus is not limited to an electrophotographic image forming apparatus, and may be any image forming apparatus, such as an inkjet or thermal transfer image forming apparatus.

(H02) Although the printer U uses developers of five colors in the above-described exemplary embodiment, the image forming apparatus is not limited to this, and may instead be, for example, a monochrome image forming apparatus or a multicolor image forming apparatus that uses four or less or six or more colors.

(H03) Although the endless band-shaped intermediate transfer belt B is described as an example of an image carrier in the above-described exemplary embodiment, the image carrier is not limited to this. The image carrier may instead be, for example, a cylindrical intermediate transfer drum, a photoconductor drum, or a photoconductor belt. Also, the intermediate transfer body may be omitted, and an image may be recorded on a sheet S directly from a photoconductor.

(H04) In the above-described exemplary embodiment, the number of blow-out holes 8 is not limited to the above-described number, and may be increased or reduced depending on, for example, the design or specifications. Although the blow-out holes 8 are arranged in the width direction in the above-described exemplary embodiment, the blow-out holes 8 may instead be disposed at different positions in the up-down direction or arranged in the up-down direction. Alternatively, a single elongated (slit-shaped) blow-out hole that extends in the width direction of the sheet S may be provided. The number of slit-shaped blow-out holes is not limited to one, and plural slit-shaped blow-out holes may be arranged with gaps therebetween in the width direction or the height direction. Thus, the shape of the blow-out holes is not limited to a circular shape, and may instead be any shape, such as an elongated shape or a rectangular shape.

(H05) Although the rotation of the fan 9 is controlled to change the flow volume in the above-described exemplary embodiment, the method for changing the flow volume is not limited to this. For example, the rotation of the fan 9 may be maintained constant while the opening area of the blow-out holes 8 is changed by using a cover (shutter) provided for the blow-out holes 8. The opening area may be reduced (blow-out holes 8 may be partly covered) when thin paper is used, and the blow-out holes 8 may be completely covered when thick paper is used.

(H06) Although the overall flow volume is controlled by the fan 9 in the above-described exemplary embodiment, the configuration is not limited to this. For example, the blow-out holes 8 may each be provided with a fan, and the rotational speed of each fan may be controlled.

(H07) Although no gas is blown against thick paper in the above-described exemplary embodiment, the configuration is not limited to this. The configuration may instead be such that gas is also blown against thick paper. In such a case, gas may be blown against thick paper at a flow volume less than that when gas is blown against plain paper. Although the configuration may be such that no gas is blown against the trailing end portion of the sheet S when the sheet S is thin paper, gas may be continuously blown against the trailing end portion of the sheet S as long as the flow volume is appropriate.

(H08) Although the finisher U3 and the printer body U1 are separate components in the above-described exemplary embodiment, the finisher U3 and the printer body U1 may instead be integrated together. Alternatively, the blowing device 6 may be installed in an image forming apparatus to which the finisher U3 is not attached.

(H09) In the above-described exemplary embodiment, the shape of the housing 7 is not limited to a rectangular tubular shape, and may be any shape, such as a round tubular shape.

(H010) In the above-described exemplary embodiment, the type of the medium is determined as thin paper, plain paper, or thick paper depending on the basis weight of the medium. However, the type of the medium is not limited to this. For example, coated paper with a surface having a high coefficient of friction may be treated similarly to plain paper, and an OHP sheet made of resin may be treated similarly to thick paper. Thus, the type of the medium may instead be determined based on parameters other than the basis weight, such as the surface characteristics and material.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A post-processing device comprising:

an output unit comprising output rollers and outputting a medium;

a stacking unit comprising an output tray and on which the medium that is output is stacked; and a blow-out unit comprising a blowing device at least including a fan and blow-out holes, wherein the blow-out unit is disposed below the output unit, the blow-out-holes blow gas along an upper surface of the output tray and toward the medium that is output, wherein an amount of the gas blown is adjusted in accordance with a type of the medium, wherein an amount of the gas blown toward a trailing end portion of a thin paper is less than an amount of the gas blown toward a trailing end portion of a plain paper, wherein the thin paper is the medium having a basis weight that is less than a predetermined first threshold, the plain paper is the medium having a basis weight that is greater than or equal to the first threshold.

2. The post-processing device according to claim 1, wherein when the medium is the thin paper, the amount of the gas blown against a trailing end portion of the medium in a direction in which the medium is transported is zero, wherein when the medium is a thick paper having a basis weight that is greater than or equal to a predetermined second threshold, the amount of the gas blown is less than when the medium is a plain paper having a basis weight that is less than the second threshold.

3. The post-processing device according to claim 2, wherein when the medium is the thick paper, the amount of the gas blown is set to zero.

4. The post-processing device according to claim 1, wherein when the medium is a thick paper having a basis weight that is greater than or equal to a predetermined second threshold, the amount of the gas blown is less than when the medium is a plain paper having a basis weight that is less than the second threshold.

5. The post-processing device according to claim 4, wherein when the medium is the thick paper, the amount of the gas blown is set to zero.

6. The post-processing device according to claim 1, wherein the amount of the gas blown toward the trailing end portion of the thin paper is half of the amount of the gas blown toward the trailing end portion of the plain paper.

7. An image forming apparatus comprising:

a recording unit comprising a marking unit including photoconductors and recording an image on a medium;

an output unit comprising output rollers and outputting the medium on which the image is recorded;

a stacking unit comprising an output tray and on which the medium that is output is stacked; and a blow-out unit comprising a blowing device at least including a fan and blow-out holes, wherein the blow-out unit is disposed below the output unit, the blow-out holes blow gas along an upper surface of the output tray and toward the medium that is output, wherein an amount of the gas blown is adjusted in accordance with a type of the medium, wherein an amount of the gas blown toward a trailing end portion of a thin paper is less than an amount of the gas blown toward a trailing end portion of a plain paper, wherein the thin paper is the medium having a basis weight that is less than a predetermined first threshold, the plain paper is the medium having a basis weight that is greater than or equal to the first threshold.

8. The image forming apparatus according to claim 7, wherein the amount of the gas blown toward the trailing end portion of the thin paper is half of the amount of the gas blown toward the trailing end portion of the plain paper.

* * * * *